United States Patent [19]

Kaffka et al.

[11] Patent Number: 4,705,216

[45] Date of Patent: Nov. 10, 1987

[54] FOUNTAIN MAINLY FOR INDOOR USE

[76] Inventors: Karoly Kaffka, 20, Abel Jeno utca, 1113 Budapest; Tibor Lezak, 12, Kun utca, 1081 Budapest; György Striker, 23/a, Katona Jozsef utca, 1137 Budapest, all of Hungary; Eva Zeisel, 600 W. 115th St., New York, N.Y. 10025

[21] Appl. No.: 796,579

[22] Filed: Nov. 8, 1985

[30] Foreign Application Priority Data

Nov. 9, 1984 [HU] Hungary ..... 4180/84

[51] Int. Cl.[4] ..... F21D 7/00; B05B 17/08

[52] U.S. Cl. ..... 239/18; 239/20; 239/23

[58] Field of Search ..... 239/16–18, 239/20–23; 415/206

[56] References Cited

U.S. PATENT DOCUMENTS

| | | | |
|---|---|---|---|
| 841,782 | 1/1907 | James | 239/16 |
| 1,020,569 | 3/1912 | Needham | 239/23 |
| 1,418,740 | 6/1922 | Shelton | 239/20 |
| 2,625,110 | 1/1953 | Haentjens et al. | 415/206 X |
| 3,619,084 | 11/1971 | Gordon | 239/23 X |
| 4,217,315 | 8/1980 | Keeler | 239/16 |
| 4,269,352 | 5/1981 | Przystawik | 239/17 |

FOREIGN PATENT DOCUMENTS

| | | | |
|---|---|---|---|
| 512434 | 9/1939 | United Kingdom | 239/23 |

*Primary Examiner*—Andres Kashnikow
*Assistant Examiner*—Patrick N. Burkhart
*Attorney, Agent, or Firm*—Michael J. Striker

[57] ABSTRACT

A fountain particularly for indoor use has a basin supported on a stand, and a storage container in which a centrifugal pump is positioned. The pump is connected to and is driven by a motor positioned in the stand with its central axis vertical and above a nominal water level in the container while the pump is immersed in the container and is positioned below that level.

8 Claims, 8 Drawing Figures

FOUNTAIN MAINLY FOR INDOOR USE

BACKGROUND OF THE INVENTION

The present invention relates to a fountain mainly for indoor use and due to its remarkably low consumption of energy operable by a low-voltage source (a battery).

Garden fountains are commonly used in building gardens. Beautiful fountains can be also installed in apartments having no gardens. These indoor fountains are in a form of small-sized table-or floor-fountain. There have already been some firms presenting table-fountains on the market, which are operated by house current, because due to a higher consumption of water pumps batteries having acceptable size to be hidden in the stand of the fountain have not enough capacity. In case of fountains operated by house current, problems of shock-protection are to be confronted with, besides the discomfort caused by the cables leading to the fountain.

An indoor fountain has been proposed, operated by an accumulator which drives a DC motor having an axle connected to the axle of a pump, thus rotating the axle of the pump. In this traditional solution both the motor and the pump are arranged under the water basin of the fountain. The axle of the pump extends through a seal into the pump housing and turns a paddle-wheel pumping water in an axis line up into a distribution head of the fountain through a pipe tangentially connected to the inner side of the pump housing. The water flushing up from the distribution head and falling down into the basin flows back to the pump inlet through a return pipe. In this solution a substantial part of capacity required to circulate water is expended in order to overcome friction at the seal, and consequently, high motor capacity and large battery or high input power are required.

SUMMARY OF THE INVENTION

It is an object of the present invention to provide a fountain of low consumption or power requirement and mainly for indoor use, which fountain can be operated preferably by low voltage supply, e.g. an accumulator or a rechargeable battery or a dry battery.

A further object of the invention is to increase operational safety of the fountain and reduce space required for the fountain and to simplify its construction.

Still another object of the invention is to substantially reduce friction and to arrange the motor of the fountain in such a manner that it would be protected against water.

These and other objects of the invention are attained by a fountain mainly for indoor use, comprising a water container having an open surface; at least one jet for discharging water; a motor; a centrifugal pump driven by said motor and connected to said jet, said motor having a central axis and being positioned above said open surface so that said central axis is vertical, said pump being coaxially connected to said motor and positioned below a maximal nominal water level in said container, said pump having a suction stub extending downwardly near a bottom of said container.

The fountain may further include a caisson closed from above, said motor being enclosed in said caisson which defines a maximal water level subjacent to said motor.

The fountain may include an upper basin and a stand supporting said basin, said basin may be said water container.

The fountain may further include a current source positioned in said stand.

The current source may be a rechargeable battery.

The pump may be a scroll-case-pump including a body, a scroll-case positioned in said body, a delivery duct extending tangentially to said scroll case and connected thereto, and a distribution duct into which said delivery duct discharges, said distribution duct being formed with a plurality of openings directed upwardly relative to said basin and each forming said jet, said motor being positioned above said openings.

The water container may be a storage tank having a first overflow pipe and positioned in said stand, said motor being positioned in said stand above a water level determined by said first overflow pipe; and wherein a second overflow pipe is provided, connected to said basin, said storage tank being connected with said basin via said second overflow pipe.

A return pipe may be provided for connecting said basin to said storage tank as well as a level control device installed in said return pipe and operated by a water level in said storage tank, said motor being positioned in said stand above a maximal water level determined by said level control device.

The pump may be a radial-flow centrifugal pump having a body, guide vanes positioned in said body and connected to said paddle wheel, said guide vanes being formed by delivery ducts extending tangentially of said paddle wheel and having distribution ducts extending from the delivery ducts, each duct having an opening directed upwardly in said basin and forming said jet, said motor being positioned above the openings.

The fountain may be provided, at least partially, with a decorative protective coating.

The fountain may include a light source including light-emitting semi-conductors mounted in a body of said pump.

The motor may be provided with a speed governer device, a light source and a program controller connected to said speed governer device.

The fountain may include a dosing device for adding to the water of various additives, and a switching device having a humidity sensor.

According to the invention, the position of the pump is determined so, that it is under the maximal nominal water level of the open surface of the basin or storage tank, while the motor is above this level. A centrifugal pump is used having its suction stub at the bottom of the container.

Due to the invention, when the fountain is provided, in addition to the basin, with the extra storage tank, the quantity of water filled in at once can be increased, i.e. more water can be discharged without refilling.

In the centrifugal pump, due to the tangential position of the delivery dust it joins the circular duct at acute angle.

The decorative character of the fountain according to the invention can be emphasized by using a decorative protective coating or a light-source illuminating the water jet flushing from the openings. Use of a light-emitting semi-conductor as a light-source is preferred. Visual glamour can be further increased by providing the pump with a speed regulator device connectable to a program device, if necessary.

The dosing device can supply to water such additives as scents, antiseptics, insecticides.

Should the fountain also be used for conditioning the air-humidity, it must have a switching device connected to the humidity sensor as mentioned above.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
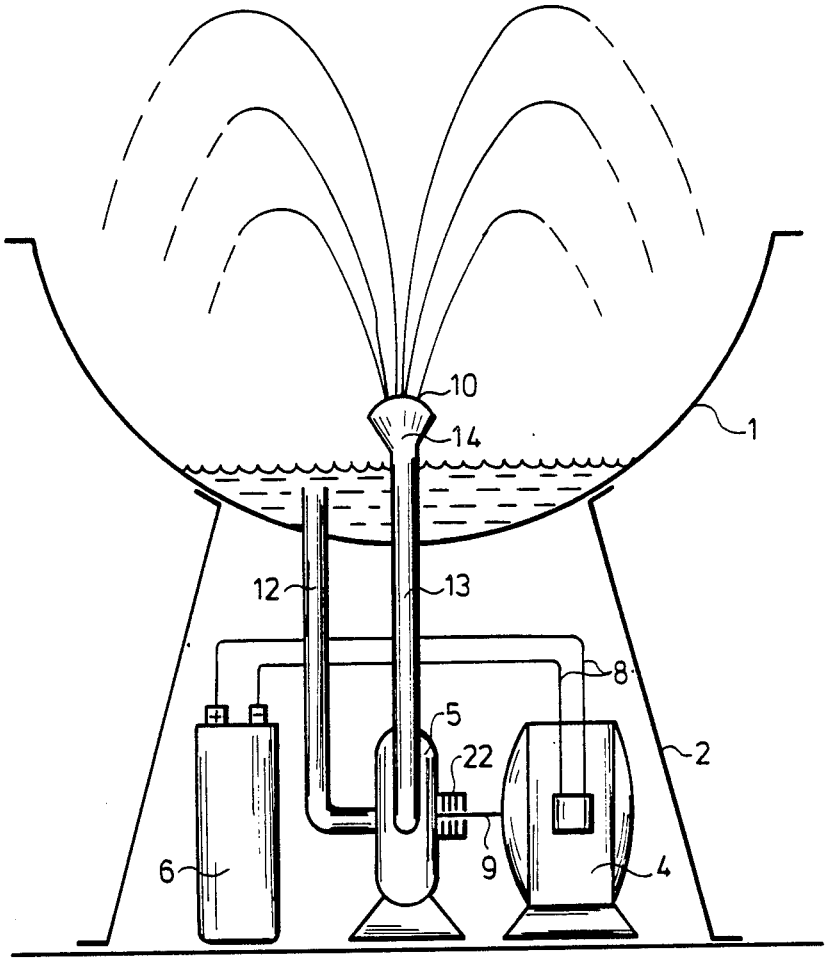
FIG. 1 is a schematic view of a conventional fountain.

FIG. 1 shows a fountain of a conventional structure, where an upper basin 1 is supported by a stand 2. A pump 5 driven by a D.C. motor 4 is placed in the stand 2. The motor 4 is connected through wires 8 to an accumulator 6. The pump 5 is connected by a delivery duct 13 to a distribution head 14 provided with jets 10. The distribution head 14 is positioned in the basin 1, which is connected via a return pipe 12 to the inlet side of the pump 5. An axle 9 of the pump 5 is connected through a seal 22 to the motor 4. Water delivered by pump 5 driven by the motor 4, flushes from jets 10 and falling down into basin 1 flows back to the inlet side of the pump 5 through the return pipe 12. In such a way the water filled into the fountain is in circulation. If there is water in the pump constantly, a safe seal has to be provided for, and this seal consumes a major part of capacity of the motor 4 during its rotation.

Figure 2:
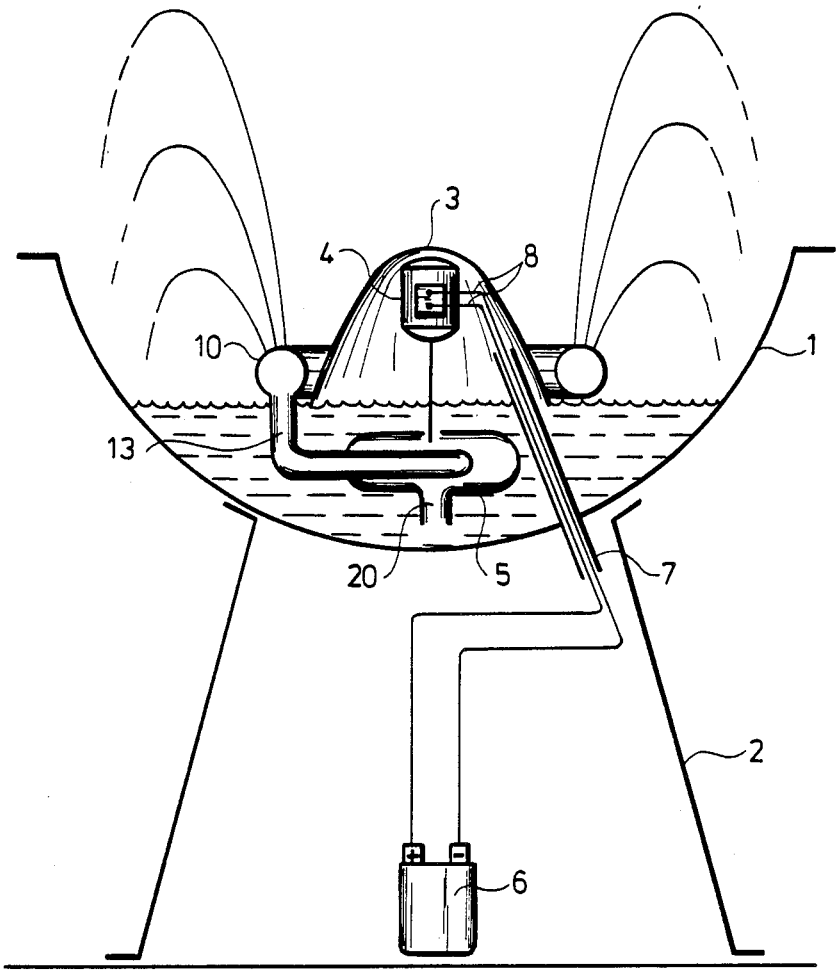
FIG. 2 is a schematic view of the fountain according to the invention.

Referring now to FIG. 2, the fountain according to the invention has contrary to the traiditional solution, a paddlewheeled pump 5 immersed in the water of the upper basin 1. The central axle of the pump 5 is connected to the motor 4, which is placed in vertical position. The motor 4 is protected from above against water by means of a cover 3. Jets 10 are connected to the pump 5 through a short delivery duct 13. Maximal nominal water level in the basin 1 of the fountain is at the same level as that of jets 10, while the motor 4 is placed above that level. In the stand 2 of the fountain there is only a single battery 6 connected to motor 4 through wires 8 extended through a channel or passage 7 over the level of jets 10. A suction stub 20 of the pump 5 extends downwardly to the level, preferably near the bottom of basin 1.

When the fountain is set into operation the basin 1 must be filled with water at least up to the level of the paddlewheel of the pump 5 to start water circulation. It is however impractical to fill it up with water over the level of the jets 10, because the height of water jet produced by the jets 10 above that level decreases significantly, or absolutely no water jet can be produced. The fountain can operate until the water level recedes due to the opening of suction stub 20. In case, if the fountain according to the invention is used for evaporation it has the advantage that it does not start operating until it is filled sufficiently, and it can evaporate by one filling such a quantity of water, the volume of which is determined by the maximal water level and the level of the suction stub. To avoid the operation of the fountain without water, mainly in case of battery operation a built-in level-switch must be used.

Figure 2A:
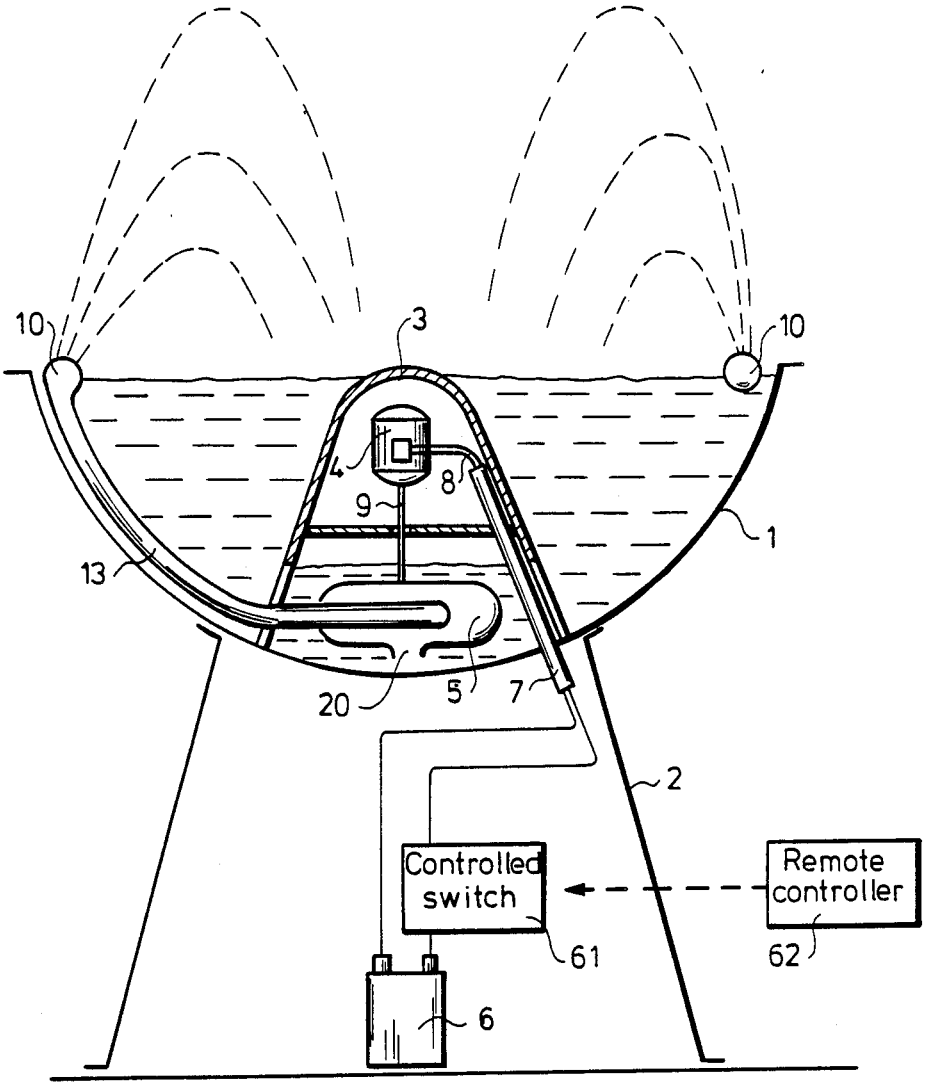
FIG. 2*a* is a schematic view of the fountain provided with the motor in a caisson.

FIG. 2*a* shows a modification of the fountain according to FIG. 2. The main difference is that the surface of water in basin 1 is defined by a caisson. The caisson is the cover 3 which is formed as a diving bell. The channel 7 with wires 8 is sealed. The level of the water surface subjacent to the motor 4 is defined by the highest apex of the cover 3. This solution enables the whole mechanism to be hidden below the water surface in the basin 1.

A further optional controlled switch 61 is connected to the battery 6. Said control switch 61 is actuated by sound, light etc. or preferably by an infrared remote controller 62. The remote controller 62 allows control of various functions of the fountain. A suitable program controller can be provided (not shown. Of course a house current supply unit can be also used instead of battery 6.

Figure 3:
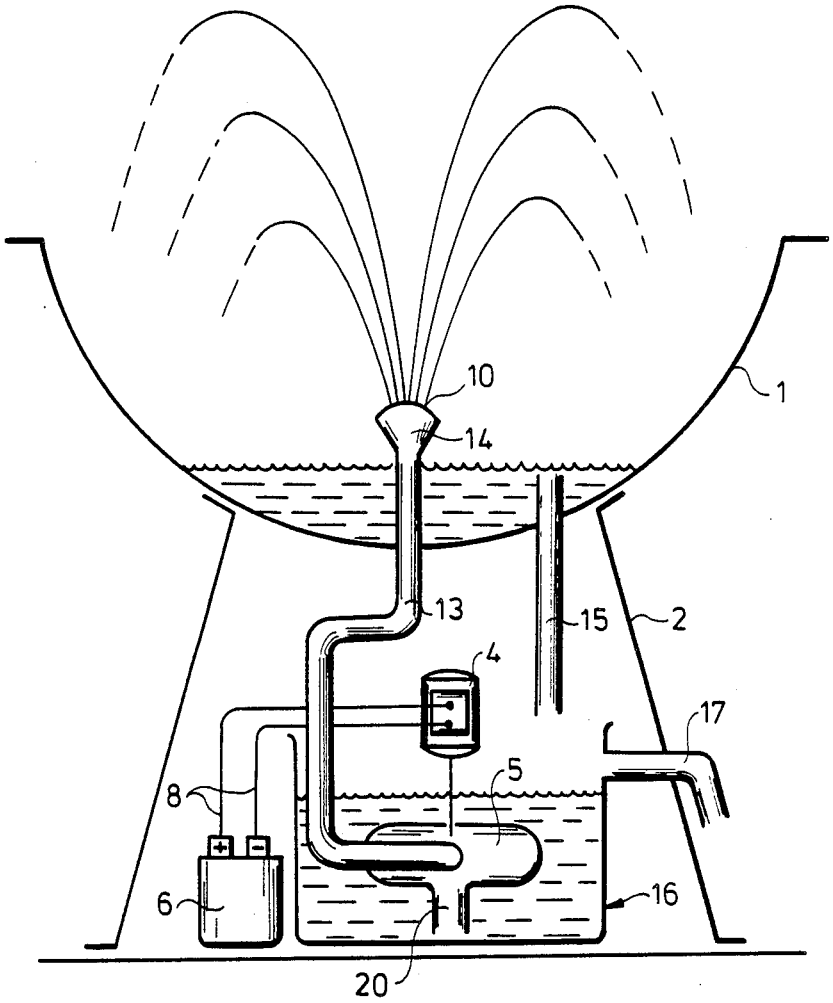
FIG. 3 is a schematic view of the fountain provided with a storage tank.

In a further embodiment of the fountain shown in FIG. 3, there is a storage tank 16 provided with an overflow pipe 17 positioned in the stand 2. The storage tank 16 is connected to the basin 1 through a second overflow pipe 15 which determines the water level in basin 1. The pump 5 is connected in the vertical direction to the motor 4 and immersed in the storage tank 16 in such a manner, that the paddle-wheel of the pump 5 is below the overflow level. The distribution head 14 provided with jets 10 is connected through the delivery duct 13 to the delivery stub of the pump 5. The storage battery 6 for supplying the motor 4 is also positioned in the stand 2.

When the fountain is set into operation, basin 1 is filled with water; then water flows into the storage tank 16 through the overflow pipe 15. The filling of the basin with water is continued until water begins to flush from the jets 10, or it begins to flow out through the overflow pipe 17. To ease the filling up of the basin the storage tank 16 can be provided with a level indicator. The water flushing and falling down flows back into the storage tank 16 through the overflow pipe 15.

Figure 4:
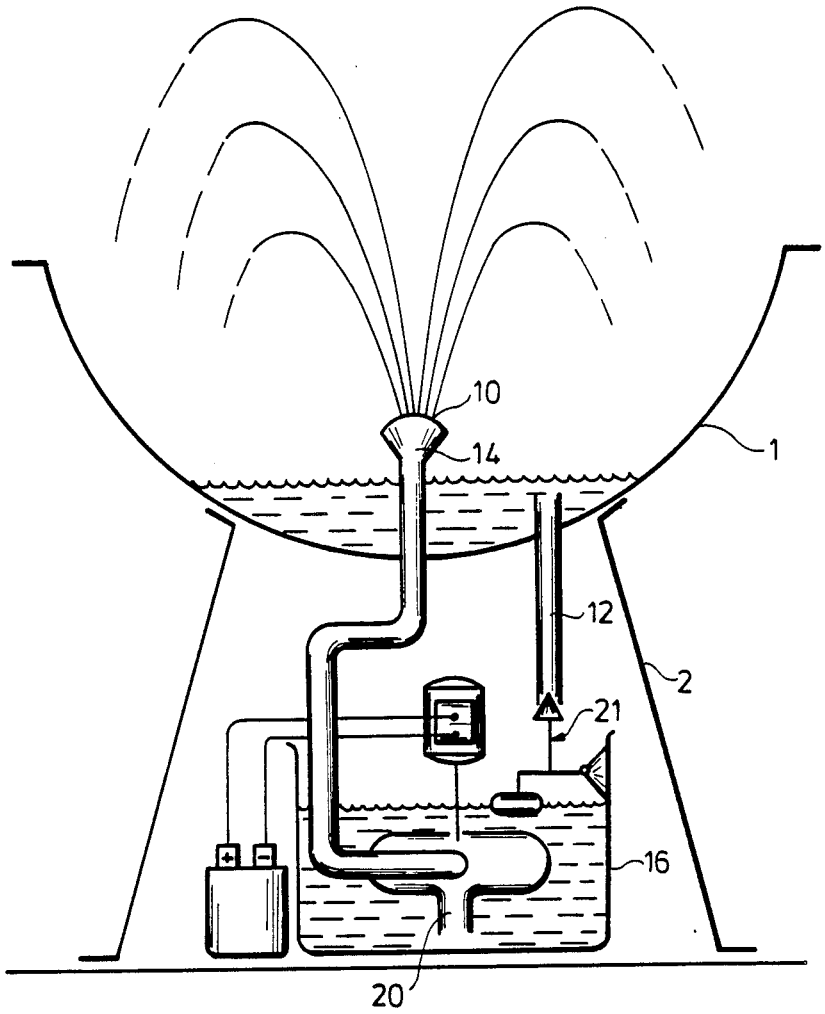
FIG. 4 is a schematic view of the fountain provided with a storage tank and a level control device.

The embodiment shown in FIG. 4 is practically the same as the embodiment shown in FIG. 2. The difference between these embodiments is that the basin 1 is connected to the storage tank 16 through the return pipe 12 provided with a level control device 21. The level control device 21 is a simple float controlled valve operated by water in the storage tank 16. Operation of the fountain according to FIG. 4 differs from one of the previously described in that water can be filled into the basin 1 until its level reaches the level of jets 10. In this case there is no need for keeping watch on the water level in the storage tank 16.

A common advantage of the embodiments shown in FIGS. 3 and 4 is that more water can be evaporated due to the fact that the actual volume of the storage tank 16 can be greater than the volume of water filled into the basin 1. Moreover, the storage tank 16 can be supplied with a dosing device 62 of any suitable conventional type which is hidden in the stand 2 and cannot be seen from outside.

In the stand 2, a known program-controller device can be placed as well, which can be connected to a light-source illuminating the water jet flushing from the jets 10 and/or to a speed governor device controlling the speed of the motor 4.

Figure 5:
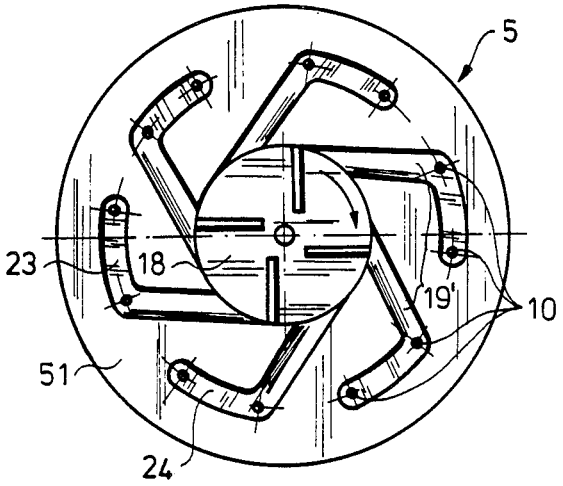
FIG. 5 is a plan bottom view showing the interior of a pump inserted in the fountain.

FIG. 5 schematically shows the pump 5 which can be preferably used in the embodiment of FIG. 2. A paddle-wheel 18 is provided in the middle of a body 51 of the pump 5. Compared to the paddle-wheel 18 positioned centrally in the body 51, there are six delivery ducts 19 tangential to the paddle wheel 18. A curved distribution duct 23 is connected to each delivery duct 19. Distribution ducts 23 are provided with jets 10 directed upwardly.

During operation the water leaving the paddle-wheel 18 in tangential direction is pushed into delivery ducts 19' the walls of which form fixed guide vanes.

Figure 6:
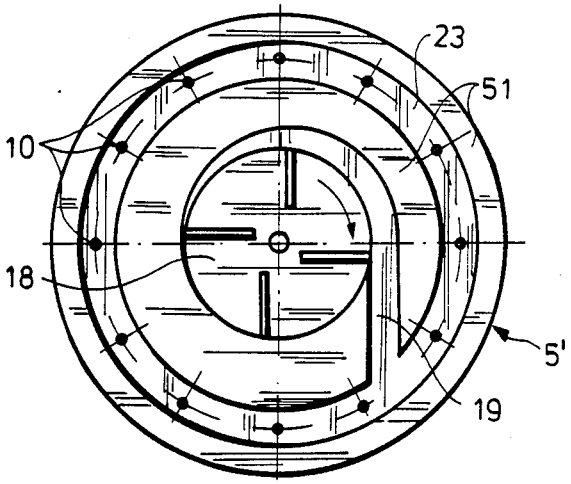
FIG. 6 is a bottom view of the pump according to a further embodiment.

The embodiment according to FIG. 6 is similar to that of FIG. 5 with the difference, that pump 5 in FIG. 6 has a scroll-case shape and the delivery duct 19 recessed in the body 51 is connected to a circular distribution duct 23, which can be closed before the mouth of the delivery duet 19, if necessary.

Pumps shown in FIGS. 5 and 6 have the common advantage that they can be produced in small size and form a single structural unit with the jets 10.

Figure 7:
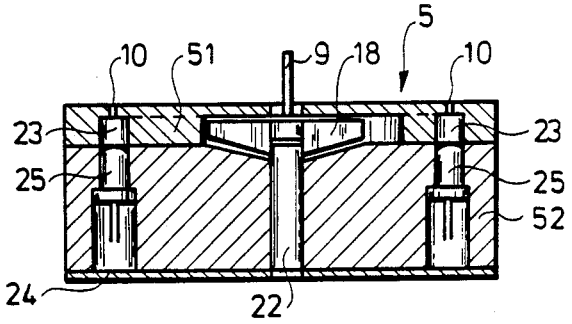
FIG. 7 is a sectional view of the pump according to FIGS. 5 and 6.

FIG. 7 is a sectional view of the pump 5 shown in FIGS. 5 and 6. The suction stub 20 of the pump 5 is formed in a cover 52 closing the body 51. In the cover 52, opposite to the jets 10, there are positioned light-sources 25 which are preferably light-emitting semi-conducting diodes insulated by a cover plate 24. Light from the light-sources 25 is emitted into the water jet acting as an optical fibre flushing from jets 10, and light emerging at curves and unevennesses of the water jets makes the water jet appear as if it radiates on its own.

For the sake of aesthetic appearance visible surfaces of the fountain according to the invention can be practically provided with a decorative protective coating 60 (FIG. 4). It is especially advantageous to use glazed pottery.

It will be understood that each of the elements described above, or two or more together, may also find a useful application in other types of indoor fountains differing from the types described above.

While the invention has been illustrated and described as embodied in an indoor fountain, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A fountain mainly for indoor use, comprising a water container having a open water surface; a stand supporting said water container; a plurality of jets for discharging water; a motor; a rechargeable battery positioned in said stand and connected to said motor; a centrifugal pump driven by said motor and connected to said jets, said motor having a central axis and being positioned above said open surface so that said central axis is vertical, said pump including a paddle-wheel, said pump being coaxially connected to said motor and positioned below a maximal nominal water level in said container, said pump having a suction stub extending downwardly up to near a bottom of said container; a delivery duct between an interior of said pump and said jets; and a plurality of light-emitting semiconductors mounted in a body of said pump for illuminating said jets.

2. The fountain as defined in claim 1, further including a caisson closed from above, said motor being enclosed in said caisson which defines a maximal water level subjacent to said motor.

3. The fountain as defined in claim 1, wherein said pump is a scroll-case pump including a body, a scroll-case positioned in said body, said delivery duct extending tangentially to said scroll-case and connected thereto, and a distribution duct into which said delivery duct discharges, said distribution duct being formed with a plurality of opening directed upwardly relative to said basin and each forming said jet, said motor being positioned above said openings.

4. The fountain as defined in claim 1, wherein said pump is a radial-flow centrifugal pump having a body, guide vanes positioned in said body and connected to said paddle wheel, a plurality of delivery ducts, said guide vanes being formed by said delivery ducts which extend tangentially of said paddle wheel and have distribution ducts extending from the delivery ducts, each duct having an opening directed upwardly in said basin and forming said jet, said motor being positioned above the openings.

5. The fountain as defined in claim 1, which is provided at least partially with a decorative protective coating.

6. The fountain as defined in claim 1, wherein said motor is provided with a controller switch, a light source and a program controller connected to said controller switch.

7. The fountain as defined in claim 1, further including a dosing device for adding to the water of various additives, and a switching device.

8. A fountain mainly for indoor use, comprising a water container having an open water surface; a plurality of jets for discharging water; a motor; a centrifugal pump driven by said motor and connected to said jets, said motor having a central axis and being positioned above said open surface so that said central axis is vertical, said pump including a paddle-wheel, said pump being coaxially connected to said motor and positioned below a maximal nominal water level in said container, said pump having a suction stub extending downwardly near a bottom of said container; and a plurality of light-emitting semi-conductors mounted on said pump so to as illuminate said jets.

* * * * *